United States Patent [19]

Busker et al.

[11] Patent Number: 4,738,752

[45] Date of Patent: Apr. 19, 1988

[54] HEATED EXTENDED NIP PRESS APPARATUS

[75] Inventors: L. H. Busker; D. C. Cronin, both of Rockton, Ill.; D. V. Lange; F. A. Macklem, both of Beloit, Wis.; J. H. Pulkowski, Beloit, Wis.

[73] Assignee: Beloit Corporation, Beloit, Wis.

[21] Appl. No.: 895,885

[22] Filed: Aug. 12, 1986

[51] Int. Cl.[4] ..... D21F 3/00; D21F 5/00

[52] U.S. Cl. ..... 162/359; 34/111; 34/116; 34/123; 100/93 R; 162/206; 162/358; 162/375

[58] Field of Search ..... 162/206, 207, 359, 375, 162/358; 100/38, 93 RP, 93 P; 165/89, 90; 34/111, 116, 123

[56] References Cited

U.S. PATENT DOCUMENTS

| | | | |
|---|---|---|---|
| 3,354,036 | 11/1967 | Gottwald et al. | 162/206 |
| 3,688,688 | 9/1972 | Kertulla et al. | 100/93 P |
| 3,799,052 | 3/1974 | Kusters et al. | 162/206 |
| 3,801,250 | 4/1974 | Kaiser et al. | 100/93 RP |
| 3,840,429 | 10/1974 | Busker et al. | 162/358 |
| 3,891,376 | 6/1975 | Gersbeck et al. | 425/373 |
| 3,973,483 | 8/1976 | Appenzeller | 34/123 |
| 4,074,441 | 2/1978 | Helversen et al. | 162/359 |
| 4,324,613 | 4/1982 | Wahren | 162/206 |
| 4,334,468 | 6/1982 | Guttinger et al. | 100/93 RP |
| 4,336,096 | 6/1982 | Dedekind | 100/93 RP |
| 4,384,514 | 5/1983 | Larive et al. | 100/93 RP |
| 4,425,190 | 1/1984 | Cronin | 162/358 |
| 4,457,683 | 7/1984 | Gerhardt et al. | 425/373 |
| 4,461,095 | 7/1984 | Lehtinen | 34/116 |

FOREIGN PATENT DOCUMENTS

| | | | |
|---|---|---|---|
| WO85/03314 | 8/1985 | PCT Int'3 1 Appl. | 162/348 |

*Primary Examiner*—S. Leon Bashore
*Assistant Examiner*—K. M. Hastings
*Attorney, Agent, or Firm*—Dirk J. Veneman; Raymond W. Campbell; David J. Archer

[57] ABSTRACT

A press apparatus is disclosed for removing fluid from a fibrous web. The apparatus includes a press member and a blanket cooperating with the press member for defining therebetween an elongate pressing section such that the web is pressed between the press member and the blanket during passage through the pressing section. The blanket is urged towards the press member such that when the web passes through the pressing section, fluid is pressed from the web. A heating device is disposed adjacent to the press roll for transferring heat to the web such that when the web passes through the pressing section, the web is subjected for an extended period to increased pressure and temperature so that water vapor generated within the pressing section during the passage of the web through the pressing section forces the fluid in the liquid phase away from the web.

10 Claims, 8 Drawing Sheets

FIG. 11
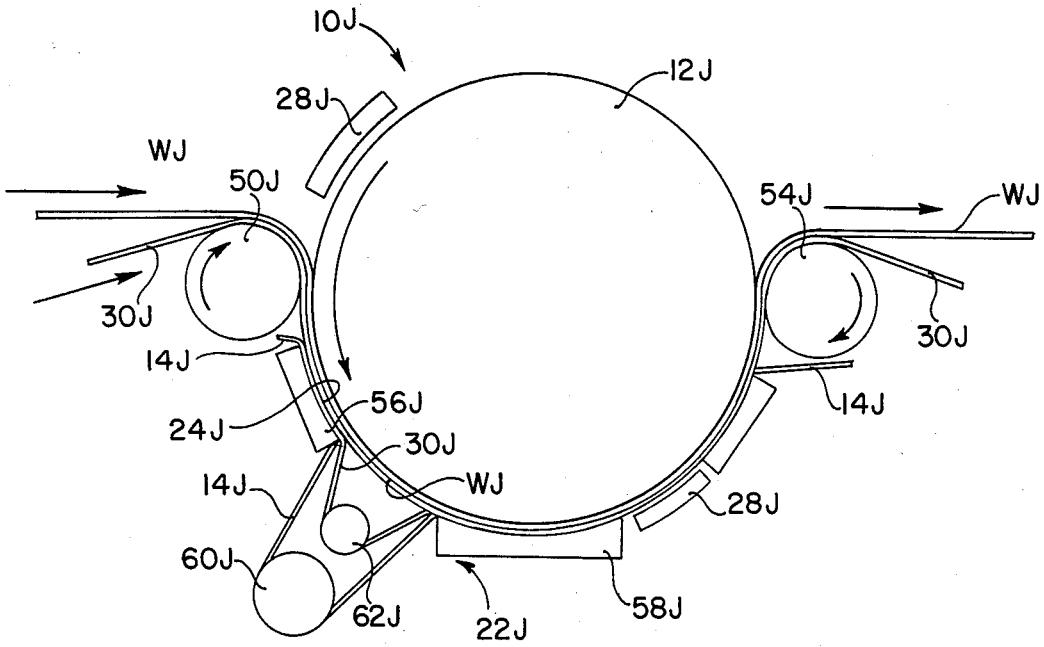
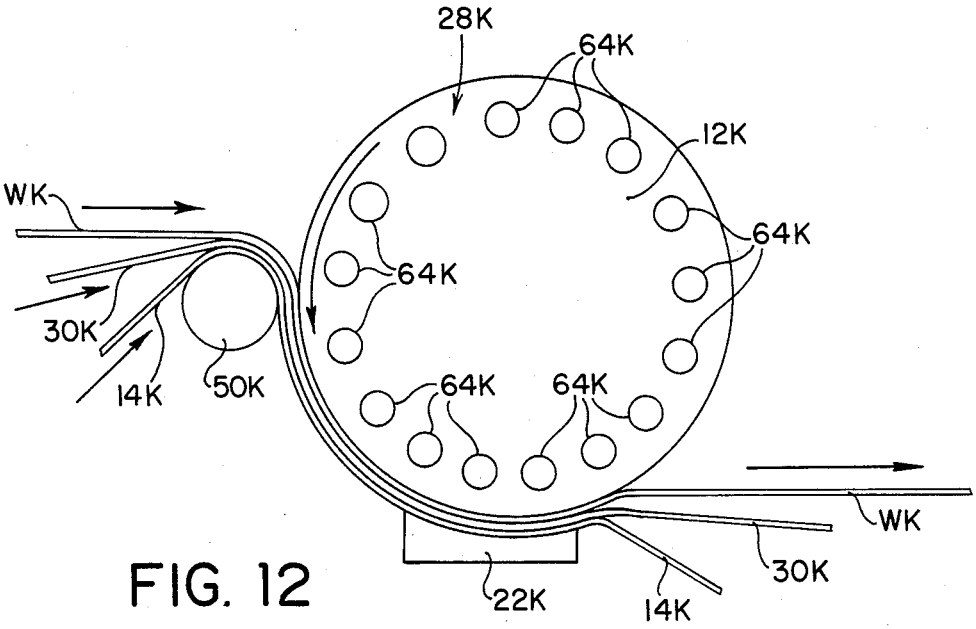
FIG. 12

HEATED EXTENDED NIP PRESS APPARATUS

BACKGROUND OF THE INVENTION

FIELD OF THE INVENTION

This invention relates to a press apparatus for removing fluid from a fibrous web. More particularly, this invention relates to a press apparatus for pressing water from a paper web.

INFORMATION DISCLOSURE STATEMENT

Over the years many advances have been made in the art of converting wood pulp into paper. Essentially, the papermaking art includes depositing a layer of fibrous pulp, or stock, onto a moving screen and draining excess water from the fibrous stock to form a relatively thin fibrous sheet on the upper surface of the screen. In order to increase the inherent strength of the fibrous sheet or web, the web is removed from the screen and passed between various pressing rolls to reduce the amount of water remaining in the web. After passage through the press section of a papermaking machine, the web having an increased density is conducted around a plurality of heated drums, or dryers, such that excess water remaining in the web after passage of the web through the pressing section is removed.

In a modern papermaking machine, it is not uncommon to have, in the drying section, eighty (80) or more dryer drums with each drum having a diameter of 5 foot (152.4 CMS) and a length of 25 foot (612 CMS). These dryer drums, of necessity, take up an enormous floor area which greatly exceeds the floor area required for the installation of the forming and press section combined. Additionally, with escalating fuel costs, it is evident that if more water can be removed in the press section, the less steam will be required in the drying section. Consequently, much research has been carried out in an attempt to remove ever greater quantities of water from the fibrous web during passage through the press section, thereby reducing the number of dryer drums required and the amount of steam required to drive off any remaining moisture within the web.

A breakthrough in press section design was commercialized in 1980 by the introduction of the so-called extended nip press hereinafter referred to as ENP which successfully reduced the amount of water remaining in the web to approximately fifty percent after pressing. The main feature of the ENP, as compared to conventional pressing techniques is as follows. In conventional pressing, the web passes through a nip defined by counter-rotating rolls, whereas in the ENP, one of the rolls is replaced by a concave shoe. The concave surface of the shoe cooperates with the outer surface of a press roll to define therebetween an elongate or extended pressing section such that the web is pressed with a moderate pressure for an extended period between the press roll and the shoe. In a conventional press, the web is subjected rapidly to a high pressure for a short period of time as the web passes through the narrow nip defined by the counter-rotating rolls. With the extended nip press, however, the pressure applied to the fibrous web increases more gradually and is applied over a longer period of time as the web passes through the extended pressing section defined by the concave surface and the cooperating press roll. This more gradual increase in pressure over a longer period of time can be accurately controlled by the design configuration of the shoe. The concavity of the shoe may be such that the radius of curvature of the shoe is greater than the radius of curvature of the cooperating press roll. In order to permit the web to pass through the extended nip, a movable blanket is disposed between the concave surface and the web so that the web is pressed between the blanket and the press roll during passage through the press section.

The extended nip press, since its introduction in 1980, has met with much success and has greatly reduced the number of dryers needed in the drying section thereby reducing not only capital costs of machinery but floor space and fuel requirements.

In an ideal situation, the web emanating from the pressing section would have the desired density and water content that would require no further treatment in a drying section. Such an ideal situation would not only eliminate the costly drying section but would provide a papermaking machine of extremely compact configuration. The present invention is directed towards a press section approaching this ideal. In order to appreciate the details of the present invention in its various embodiments, (to be described hereinafter) it is necessary to understand the basic concept concerning the effects of increasing the pressure over an extended period together with increasing the temperature of the web passing through the pressing section.

With currently-designed extended nip presses, the web is subjected for an extended period to increased pressure. Furthermore, the web prior to passing through the extended nip is heated by means of steam because such increase in temperature assists in removing moisture from the web. In a typical extended nip press, the pressure applied to the web by the shoe is in the order of 600 psi which pressure is applied relatively uniformly to the web as the web passes through the pressing section which may be approximately 10 inches (25.4 CMS) in length. Moisture within the web during passage through the pressing section, is rapidly squeezed from the fibrous web and the water removed from the web is taken up by one or more felts concurrently passing through the pressing section. Any desired pressure profile may be achieved by varying the shoe configuration of the ENP.

The present invention is directed to the removal of even greater quantities of water from the fibrous web by the application of high temperatures to the web as it passes through the pressing section. As web temperatures of 212° F. or more are reached during passage through the pressing section, it is apparent that the combined effect of temperature, pressure and time cause the rapid evolution of water vapor within the fibrous web. This water vapor forces the remaining water in the liquid phase out of the fibrous web thereby resulting in a fibrous web having not only the desired density requirement but also the required dryness with up to 100% of the water being removed from the web during the pressing operation.

During passage through the pressing section, it is understood that the web undergoes various fluid removal phases according to the present invention. The first phase is a thermally-augmented wet pressing phase. This first phase is followed by a second phase in which a large proportion of liquid remaining in the web is displaced by the water vapor generated within the pressing section. A third phase includes pressurized flash drying and a fourth phase includes unpressured flash drying as the web exits from the pressing section.

Not only does the present invention provide a revolutionary process for producing a fibrous web having the desired characteristics, but also by the application of high temperature, it is possible to reduce the pressure requirement to a level such that conventional oil loading of the shoe may be replaced by hydraulic loading utilizing water as the pressure medium. Previously, with the use of oil as a pressure medium, various steps were necessary in order to avoid contamination of the fibrous web with oil particles from the hydraulic loading system.

Furthermore, in the conventional ENP, oil was supplied between the concave surface of the shoe and the blanket in order to lubricate passage of the blanket through the pressing section. However, with a reduction in pressure requirements, made possible by the increased temperature of operation according to the present invention, instead of oil being used as the lubricating medium between the blanket and the shoe, water may be used as the lubricant thereby further avoiding various contamination problems.

From the foregoing, it is evident that many variations of the basic concept of supplying an increased temperature to the web are envisaged by the present invention. It is therefore a primary objective of the present invention to provide a press apparatus that overcomes the inadequacies of the prior art devices and that provides an apparatus and method that offers a significant contribution to the papermaking art.

Another object of the present invention is the provision of a press apparatus in which the web is subjected, for an extended period, to high pressure and high temperature in order to effect an increased removal of water from the fibrous web.

Another object of the present invention is the provision of a press apparatus in which a press member defines a convex surface which cooperates with the concave surface of an ENP shoe for removing fluid from a web extending therethrough.

Another objective of the present invention is the provision of a press apparatus including heating means disposed adjacent to the press roll for heating the web such that when the web passes through the pressing section, the web is subjected for an extended period to increased pressure and temperature so that water vapor generated within the pressing section during the passage of the web through the pressing section forces the fluid in the liquid and/or vapor phase away from the web.

Another object of the present invention is the provision of a press apparatus including a press roll having a first and second coaxial layer with the second layer extending around the first layer and having a coefficient of thermal conductivity greater than the coefficient of thermal conductivity of the first layer so that heat may be effectively transmitted to the web and so that flow of heat through the first layer may be inhibited during passage of the web through the pressing section.

Another object of the present invention is the provision of a press apparatus having a secondary roll and a heat transfer means which extends around the press roll and the secondary roll for transferring thermal energy from the heating means to the web.

Another objective of the present invention is the provision of a press apparatus in which the heat transfer means extends through a secondary heating means disposed adjacent to the secondary roll for heating the heat transfer means to enable heat to be transferred effectively to the web during passage through the press section.

Another objective of the present invention is the provision of a press apparatus including a supplementary press roll and a transfer roll disposed adjacent to the press roll such that the supplementary roll and the press roll define therebetween a press nip such that the web is guided through the press nip before passing through the pressing section for effecting an initial removal of fluid from the web.

Another objective of the present invention is the provision of a press apparatus including a supplementary press roll, a transfer roll and a thermal transfer means which extends around the supplementary press roll and the transfer roll such that the web is moved, together with, and between the thermal transfer means and the press roll and between the supplementary press roll and the transfer roll.

Another objective of the present invention is the provision of a press apparatus including a supplementary press roll, a transfer roll and blanket means extending around the supplementary press roll and between the supplementary press roll and the press roll. The blanket means extends around the press roll and between the press roll and the transfer roll such that movement of the supplementary press roll and the transfer roll towards each other results in an increase in pressure exerted by the blanket means against the web disposed between the blanket means and the press roll. Such increase in pressure in conjunction with the increased temperature applied for an extended period causes water vapor generated within the pressing section to drive the fluid out of the web.

Another objective of the present invention is the provision of a first shoe which defines a concave surface which cooperates with the press roll such that when the blanket means moves relative to the concave surface, the blanket means and the press roll press the web therebetween.

Another objective of the present invention is the provision of a press apparatus in which the heating means includes at least one induction heater disposed adjacent to the press roll.

Other objects and advantages of the present invention will be apparent to those skilled in the art by a consideration of the detailed description taken in conjunction with the annexed drawings and by consideration of the appended claims which define the scope of the present invention.

SUMMARY OF THE INVENTION

The present invention relates to a press apparatus and a method for pressing fluid from a fibrous web. This invention also includes a web produced by such method. The press apparatus includes a press member and a blanket means cooperating with the press member for defining therebetween an elongate pressing section such that the web is pressed between the press member and the blanket means during passage through the pressing section. The apparatus includes elongate means for urging the blanket towards the press member such that when the web passes through the pressing section, fluid is removed from the web. Heating means are disposed adjacent to the press member for transferring heat to the web such that when the web passes through the pressing section, the web is subjected for an extended period to increased pressure and temperature so that water vapor generated within the pressing section during passage of the web through the pressing section forces the fluid in the liquid phase away from the web.

In one embodiment of the present invention, the press member defines a convex surface which cooperates with a concave surface of an ENP.

In another embodiment of the present invention, a press roll defines a smooth, cylindrical pressing surface. In another embodiment, the surface of the press roll is porous. In various alternative embodiments of the present invention, the cylindrical pressing surface is vented or grooved. In another embodiment, the press roll surface is metallic.

In a further embodiment of the present invention, the press roll includes a first coaxial layer and a second coaxial layer extending around the first layer with the second layer having a coefficient of thermal conductivity greater than the coefficient of thermal conductivity of the first layer. The first layer is a material having a low coefficient of thermal conductivity and the second layer is metallic. In a modification of this embodiment, the first layer is ceramic and the second layer is metallic. In another modification of this embodiment, the first layer has a thickness which is greater than the thickness of the second layer.

In another embodiment of the present invention, the press apparatus includes a secondary roll and thermal transfer means which extend around the press roll and the secondary roll for transferring thermal energy from the heating means to the web. The coefficient of thermal conductivity of the secondary roll are each less than the coefficient of thermal conductivity of the thermal transfer means.

In another embodiment of the present invention, the press roll and the secondary roll each have a thermal mass which is greater than the thermal mass of the thermal transfer means.

In another embodiment of the present invention, the thermal transfer means and the secondary roll define therebetween, a secondary heating section. The apparatus further includes secondary heating means disposed adjacent to the secondary roll for heating the thermal transfer means during passage of the thermal transfer means through the secondary heating section.

In a more specific embodiment of the invention, the secondary heating means further includes a hood which extends along the secondary heating section with a direct-flame heater disposed within the hood for directly heating the thermal transfer means such that when the heated thermal transfer means rotates around the press roll, heat is transferred from the thermal transfer means to the web.

In another embodiment of the present invention, the press apparatus includes a blanket means which moves relative to the elongate means with the blanket means and the pressing surface moving relative to the pressing section at the same speed and in the same direction having the web disposed therebetween. In various modifications of this embodiment, the blanket means is plain, vented or grooved.

In another embodiment of the present invention, the press apparatus includes a supplementary press roll disposed adjacent to the press roll such that the supplementary press roll and the press roll define therebetween, a press nip. The web is guided through the press nip before passing through the pressing section for effecting an initial removal of fluid from the web. In a modification of this embodiment, the blanket means extends through the press nip and the pressing section.

In yet a further modification, the press apparatus includes a transfer roll disposed adjacent to the press roll and downstream relative to the pressing section with the blanket means extending through the first nip, the pressing section and between the transfer roll and the press roll.

In another embodiment of the present invention, the press apparatus includes a supplementary press roll which is disposed adjacent to the press roll. The apparatus also includes a transfer roll disposed adjacent to the press roll such that the pressing section is disposed between the supplementary press roll and the transfer roll. A thermal transfer means extends around the supplementary press roll and the transfer roll such that the web is moved, together with, and between the thermal transfer means and the press roll between the supplementary press roll and the transfer roll. In a further modification of this embodiment, the thermal transfer means is metallic such that heat supplied to the thermal transfer means by the heating means is readily transferred to the web. In yet a further modification of this embodiment, the thermal transfer means has a greater coefficient of thermal conductivity than the blanket means such that heat supplied to the thermal transfer means tends to be transferred to the web rather than to the blanket means. In a further modification, the thermal transfer means has a thermal mass which is less than the thermal mass of the press roll such that in the event of the web breaking, heat supplied to the thermal transfer means rapidly dissipates.

In a further embodiment of the present invention, the press apparatus includes a supplementary press roll and a transfer roll with the supplementary and transfer rolls disposed adjacent to the press roll and the blanket means extending around the supplementary press roll and between the supplementary press roll and the press roll. The blanket means extends around the press roll and between the press roll and the transfer roll such that movement of the supplementary press roll and the transfer roll towards each other results in an increase in pressure exerted by the blanket means against the web disposed between the blanket means and the press roll. Such increase in pressure in conjunction with the increased temperature applied for an extended period causes water vapor generated within the pressing section to drive the fluid in the liquid and/or gaseous phase out of the web.

In a further embodiment of the present invention, the press apparatus includes a felt disposed between the blanket means and the web.

In a more specific embodiment of the present invention, the means for urging the blanket means towards the press roll includes a first shoe which defines a concave surface. The concave surface cooperates with the press roll such that when the blanket means moves relative to the concave surface, the blanket means and the press roll press the web therebetween.

In another embodiment of the present invention, the press apparatus includes a second shoe and first guide means disposed between the first and second shoes with the first guide means being disposed remote relative to the press roll. The blanket means extends around the first guide means such that the blanket means is removed from the web between the first and the second shoes. In a modification of this embodiment, the felt is disposed between the web and the blanket means and a second guide means is disposed between the first and second shoes with the second guide means being disposed remote relative to the press roll. Furthermore, the felt extends around the second guide means such that the first felt is removed from the web for inhibiting rewetting of the web.

In another embodiment of the present invention, the heating means is a first induction heater. Alternatively, the heating means is an infrared heater, microwave heater, laser heater or an electrical resistance heater. Alternatively, the heating means includes means for circulating heated oil throughout the press roll.

More specifically, the first induction heater is disposed adjacent to the press roll and away from the pressing section such that the press roll is heated prior to coming into contact with the web. In a modification of this embodiment, a second induction heater is disposed adjacent to the pressing section upstream relative to the pressing section so that the web is heated immediately prior to the application of the increased pressure.

In another embodiment of the present invention, the press apparatus includes a plurality of shoes, each of which define a concave surface which cooperate with the blanket means. Additionally, the press apparatus includes a plurality of supplementary induction heaters, each supplementary heater being disposed between adjacent shoes of the plurality of shoes.

In another embodiment of the present invention, the pressing apparatus includes preheating means for heating the web prior to the web extending around the press roll. The preheating means including a steam box and a vacuum slot for drawing steam into the web.

The present invention is not limited to the various embodiments stated hereinbefore and described hereinafter in the detailed description. These various embodiments are given merely by way of example to illustrate various ways of carrying out the concept of the present invention. It will be apparent to those skilled in the art that many variations of the present invention may be made without departing from the spirit and scope of the invention as defined by the appended claims. Although the present invention is described with particular application to the pressing of a fibrous web for the production of paper and board, it will be evident to those skilled in the art that the present invention may be equally applied to any process that requires removal of fluid from a fibrous web.

BRIEF DESCRIPTION OF THE DRAWINGS

FIG. 11 is a side elevational view of an eleventh embodiment of the present invention;

FIG. 12 is a side elevational view of a twelfth embodiment of the present invention;

Similar reference characters refer to similar parts throughout the various embodiments of the present invention.

DETAILED DESCRIPTION

Figure 1:
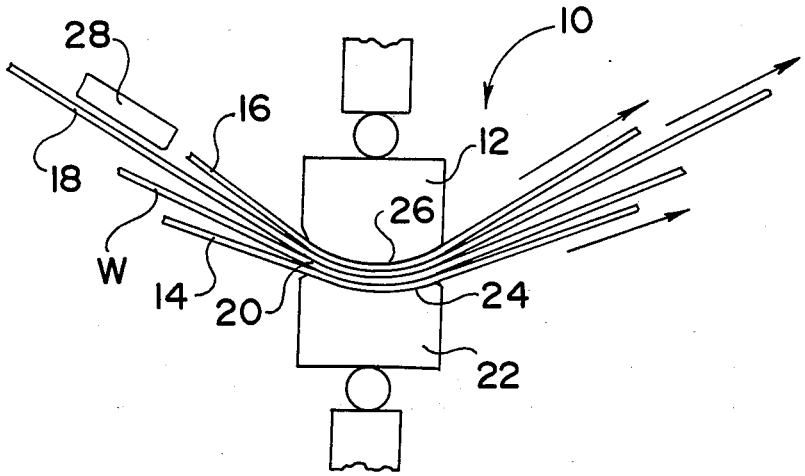
FIG. 1 is a side-elevational view of a press apparatus according to a first embodiment of the present invention.

FIG. 1 is a side elevational view of a press apparatus according to a first embodiment of the present invention. The press apparatus generally designated 10 includes a press member 12 and a blanket means 14. A further blanket means 16 is disposed between the press member 12 and the blanket means 14. A thermal transfer means 18 is disposed between the blankets 14 and 16 such that the thermal transfer means 18 and the blanket means 14 define therebetween an elongate pressing section 20 so that a web W is pressed between the thermal transfer means 18 and the blanket means 14 during passage through the pressing section 20. An elongate means or shoe 22 urges the blanket 14 towards the press member 12 and the shoe 22 defines a concave surface 24 which cooperates with a convex surface 26 defined by the press member 12 so that as the blanket 14, web W, thermal transfer means 18 and further blanket 16 pass between the surfaces 24 and 26, the web is pressed for removing fluid therefrom. A heating means 28 is disposed adjacent to the press member 12 for transferring heat to the web W. The heating means 28 transfers heat to the thermal transfer means 18 so that such heat is transferred to the web W during passage of the web W and thermal transfer means 18 through the pressing section 20.

Figure 2:
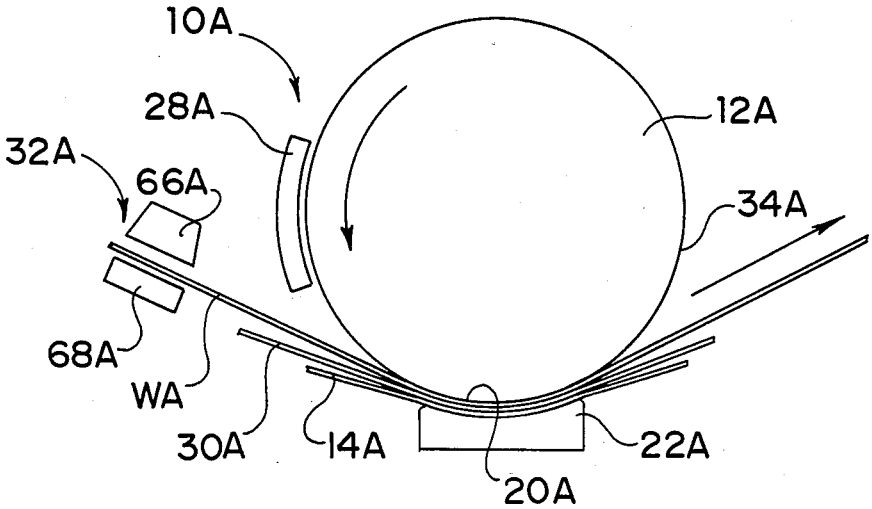
FIG. 2 is a side elevational view of a second embodiment of the present invention.

FIG. 2 is a side elevational view of a press apparatus generally designated 10A according to a a second embodiment of the present invention. The press apparatus 10A includes a rotatable press roll 12A and a blanket means 14A which cooperate with the press roll 12A for defining therebetween an elongate pressing section 20A such that a web WA is pressed between the roll 12A and the blanket means 14A during passage through the pressing section 20A. The press apparatus 10A includes elongate means 22A for urging the blanket means 14A towards the roll 12A such that when the web WA passes through the pressing section 20A fluid within the web WA is pressed from the web WA. The press apparatus 10A also includes heating means 28A disposed adjacent to the press roll 12A for heat to the web WA such that when the web WA passes through the pressing section 20A the web WA is subjected for an extended period to increased pressure and temperature so that water vapor generated within the press section 20A during the passage of the web WA through the pressing section 20A forces the fluid in the liquid phase away from the web WA.

As shown in FIG. 2, a felt 30A is disposed between the blanket means 14A and the web WA for carrying away fluid pressed from the web WA during passage of the web WA through the pressing section 20A. Also, as shown in FIG. 2, the web is preheated by a preheater means generally designated 32A. Furthermore, the press roll 12A defines a smooth, cylindrical pressing surface 34A.

Figure 3:
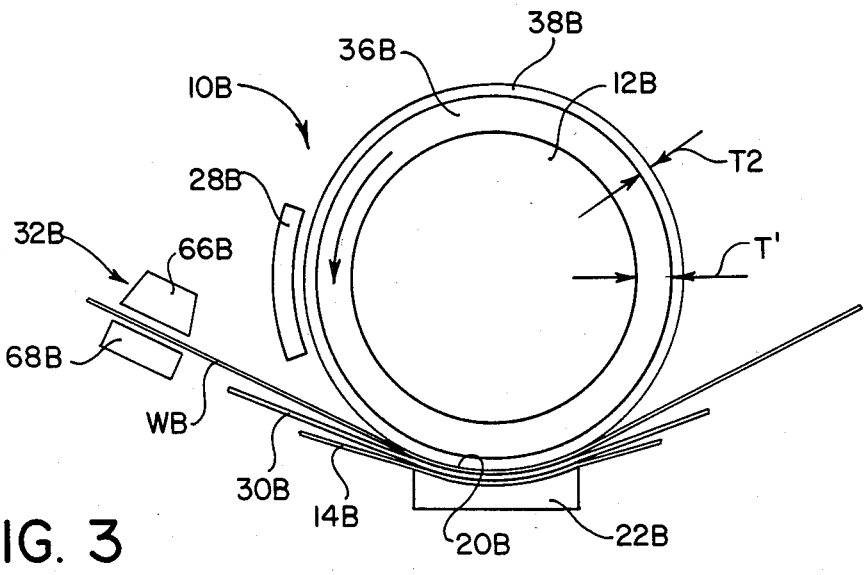
FIG. 3 is a side elevational view of a third embodiment of the present invention.

FIG. 3 shows a third embodiment of the present invention in which a press apparatus generally designated 10B includes a press roll 12B having a first coaxial layer 36B and a second coaxial layer 38B extending around the first layer 36B with the second layer 38B having a coefficient of thermal conductivity which is greater than the coefficient of thermal conductivity of the first layer 36B. The first layer 36B is of a material having a low coefficient of thermal conductivity and the second layer 38B may be metallic. Alternatively, the first layer 36B may be ceramic while the second layer 38B is metallic. As shown in FIG. 3, the first layer 36B has a thickness T1 which is greater than the thickness T2 of the second layer 38B and preferably the second layer 38B has a thickness T2 within the range 0.005 inches to 0.050 inches (0.0127 centimeters to 1.27 centimeters) so that heat supplied by the heating means 28B to the second layer 38B for heating the web WB is transferred to the web WB and the first layer 36B inhibits dissipation of the heat towards the rotational axis of the press roll 12B.

Figure 4:
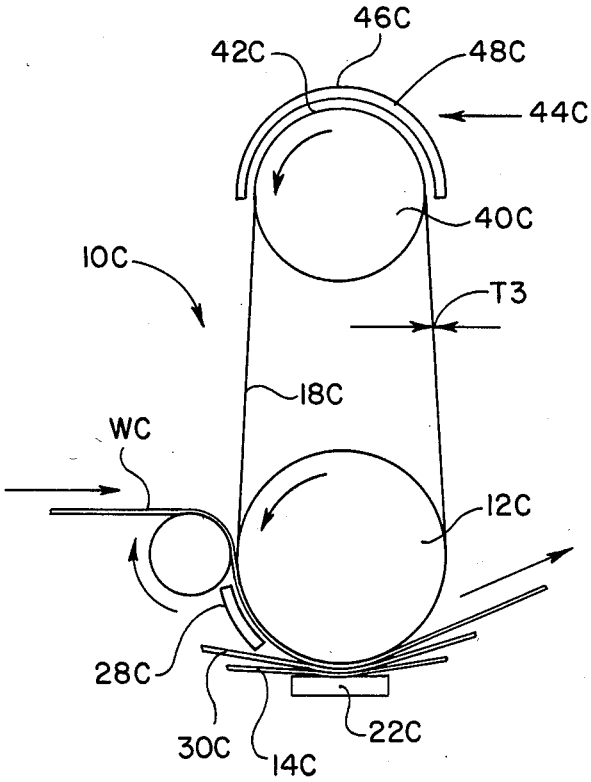
FIG. 4 is a side elevational view of a fourth embodiment of the present invention.

FIG. 4 shows a fourth embodiment of the present invention in which a press apparatus 10C includes a press roll 12C and a secondary roll 40C. A thermal transfer means 18C extends around the press roll 12C and the secondary roll 40C for transferring thermal energy from the heating means 28C to the web WC. The coefficient of thermal conductivity of the press roll 12C and the coefficient of thermal conductivity of the secondary roll 40C each are less than the coefficient of thermal conductivity of the thermal transfer means 18C. Additionally, the press roll 12C and the secondary roll 40C each have a thermal mass which is greater than the thermal mass of the thermal transfer means 18C. The thermal transfer means 18C has a thickness T3 within the range 0.005 inches to 0.2 inches (0.0127 centimeters to 0.508 centimeters). Preferably the thermal transfer means 18C is metallic and the thermal transfer means 18C and the secondary roll 40C define therebetween a secondary heating section 42C. A secondary heating means generally designated 44C is disposed adjacent to the secondary roll 40C for heating the the thermal transfer means 18C during passage of the thermal transfer means 18C through the secondary heating section 42C. More specifically, the secondary heating means 44C includes a hood 46C which extends along the secondary heating section 42C. A direct-flame heater 48C is disposed within the hood 46C for directly heating the thermal transfer means 18C such that when the thermal transfer means 18C rotates around the press roll 12C, heat is transferred from the thermal transfer means 18C to the web WC.

Figure 5:
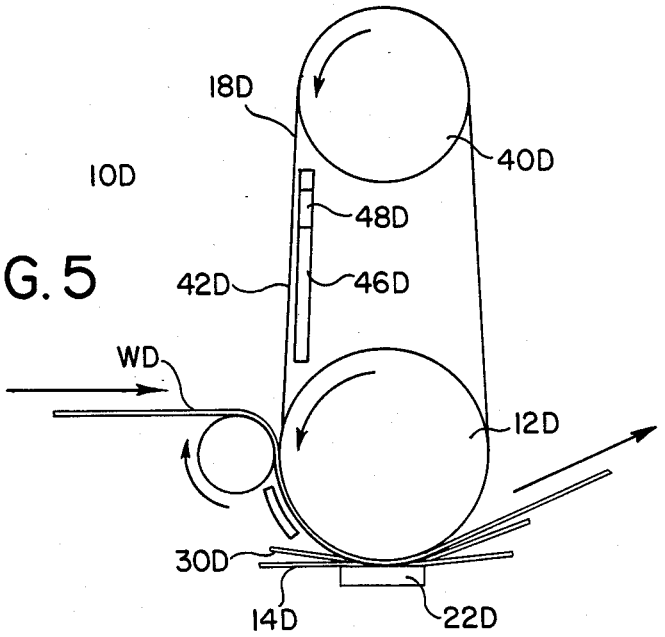
FIG. 5 is a side elevational view of a fifth embodiment of the present invention.

FIG. 5 shows a fifth embodiment of the present invention which is similar to the embodiment shown in FIG. 4 except in that the hood 46D is disposed between the rolls 12D and 40D such that the direct-flame heater 48D heats the thermal transfer means 18D on the inner surface thereof during passage through the secondary heating section 42D.

Figure 6:
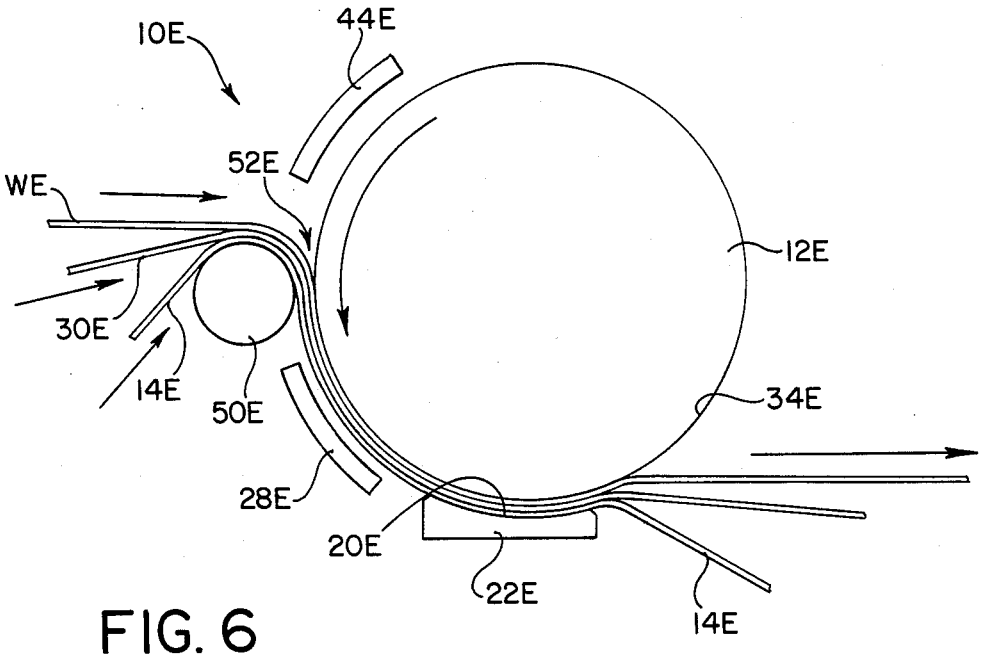
FIG. 6 is a side elevational view of a sixth embodiment of the present invention.

FIG. 6 shows a sixth embodiment of the present invention which includes a press apparatus 10E having a press roll 12E and a blanket means 14E. The blanket means 14E moves relative to the elongate means 22E with the blanket means 14E and the pressing surface 34E of the press roll 12E moving relative to the press section 20E at the same speed and in the same direction having the web WE disposed therebetween. As shown in FIG. 6, the press apparatus 10E further includes a supplementary press roll 50E which is disposed adjacent to the press roll 12E such that the supplementary press roll 50E and the press roll 12E define therebetween a press nip generally designated 52E such that the web WE is guided through the press nip 52E before passing through the pressing section 20E for effecting an initial removal of fluid from the web WE.

Figure 7:
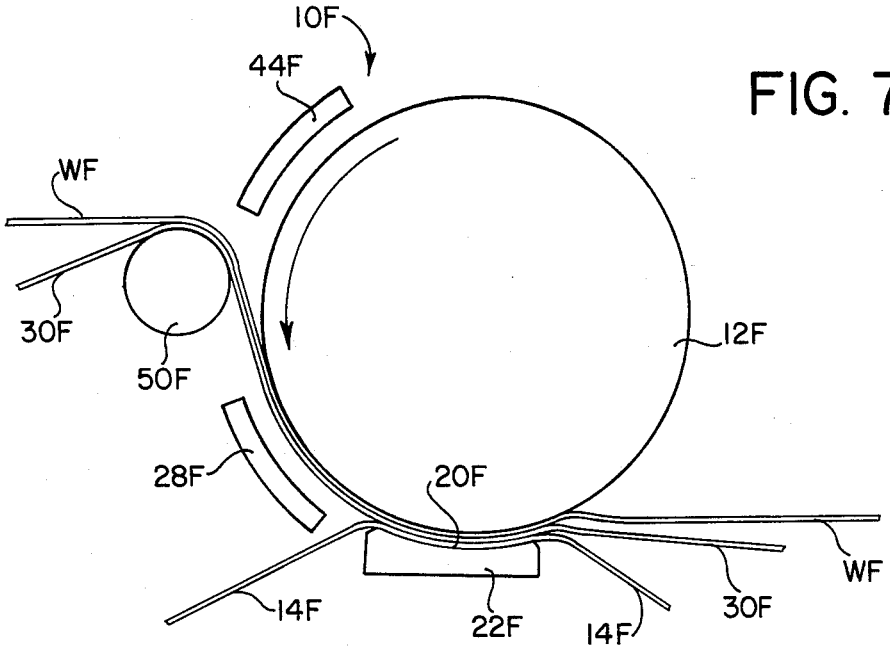
FIG. 7 is a side elevational view of a seventh embodiment of the present invention.

In a seventh embodiment of the present invention, as shown in FIG. 7, blanket means 14F only extend through the pressing section 20F and the supplementary roll 50F does not define a nip relative to the press roll 12F.

Figure 8:
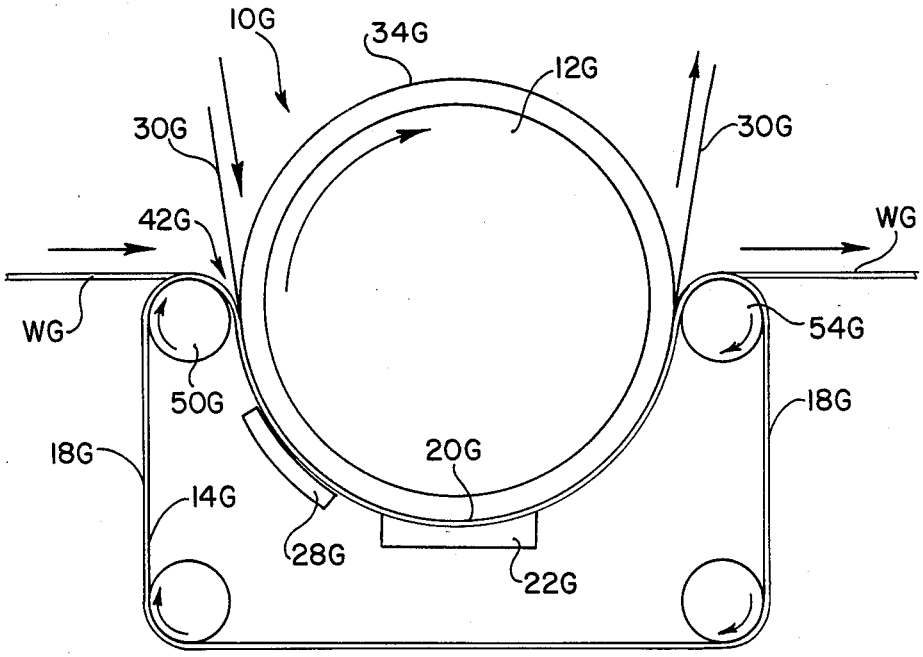
FIG. 8 is a side elevational view of an eighth embodiment of the present invention.

FIG. 8 shows an eighth embodiment of the present invention in which a press apparatus 10G includes a press roll 12G and a transfer roll 54G disposed adjacent to the press roll 12G and downstream relative to the pressing section 20G. As shown in FIG. 8, the blanket means 14G extends through the press nip 42G defined by the supplementary press roll 50G and the press roll 12G. The blanket means 14G extends through the pressing section 20G and between the transfer roll 54G and the press roll 12G. As shown in FIG. 8, the press apparatus 10G also includes a thermal transfer means 18G which extends around the supplementary press roll 50G and the transfer roll 54G with the thermal transfer means 18G following the same path as that of the blanket means 14G such that the web WG is moved together with and between the thermal transfer means 18G and the press roll 12G between the supplementary press roll 50G and the transfer roll 54G. Preferably, the thermal transfer means 18G is metallic such that heat supplied to the thermal transfer means 18G by the heating means 28G is readily transferred to the web WG. Preferably the thermal transfer means 18G has a greater coefficient of thermal conductivity than the blanket means 14G such that heat supplied to the thermal transfer means 18G tends to be transferred to the web WG rather than to the blanket means 14G. The thermal transfer means 18G preferably has a thermal mass which is less than the thermal mass of the press roll 12G such that in the event of the web WG breaking, heat supplied to the thermal transfer means 18G rapidly dissipates.

As shown in FIG. 8, the pressing surface 34G of the press roll 12G is porous. However, the press roll may be vented or grooved and may be metallic such that fluid removed from the web WG and taken up by the felt 30G may, at least partially, be removed through the press roll 12G.

Figure 9:
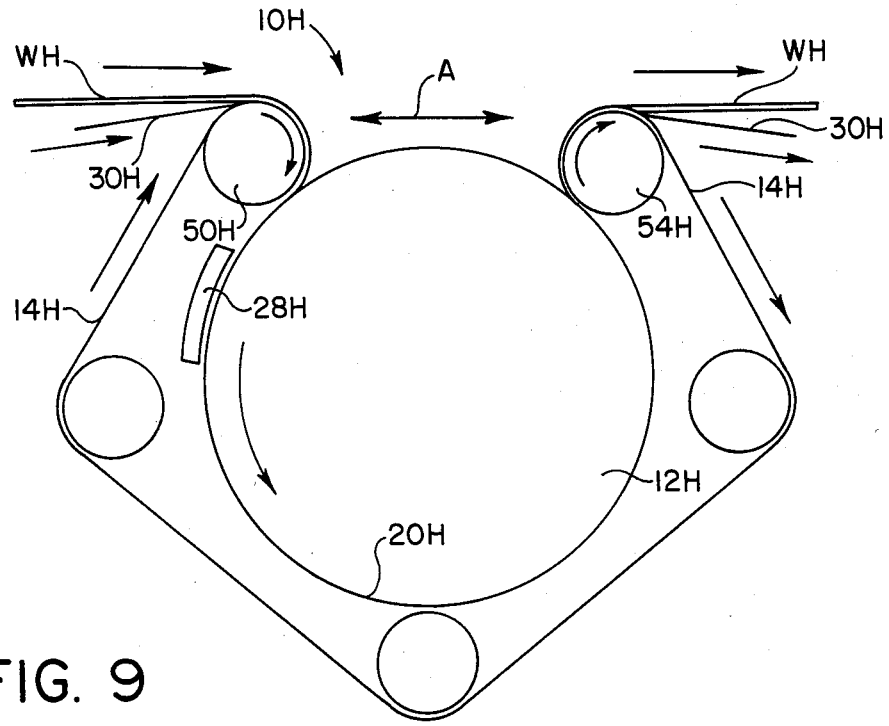
FIG. 9 is a side elevational view of a ninth embodiment of the present invention.

FIG. 9 shows a ninth embodiment of the present invention in which a press apparatus generally designated 10H includes a press roll 12H and the supplementary press roll 50H disposed adjacent to the press roll 12H. A transfer roll 54H is disposed adjacent to the press roll 12H such that the pressing section 20H is disposed between the supplementary press roll 50H and the transfer roll 54H. The press apparatus 10H also includes blanket means 14H which extend around the supplementary press roll 50H and between the supplementary press roll 50H and the press roll 12H. The blanket means 14H extend around the press roll 12H and between the press roll 12H and the transfer roll 54H such that movement of the supplementary press roll 50H and the transfer roll 54H towards each other as indicated by the arrow A results in an increase in pressure exerted by the blanket means 14H against the web WH disposed between the blanket means 14H and the press roll 12H. This increase in pressure, in conjunction with increased temperature from the heating means 28H applied for an extended period causes water vapor generated within the pressing section 20H to drive the fluid in the liquid phase out of the web WH.

Figure 10:
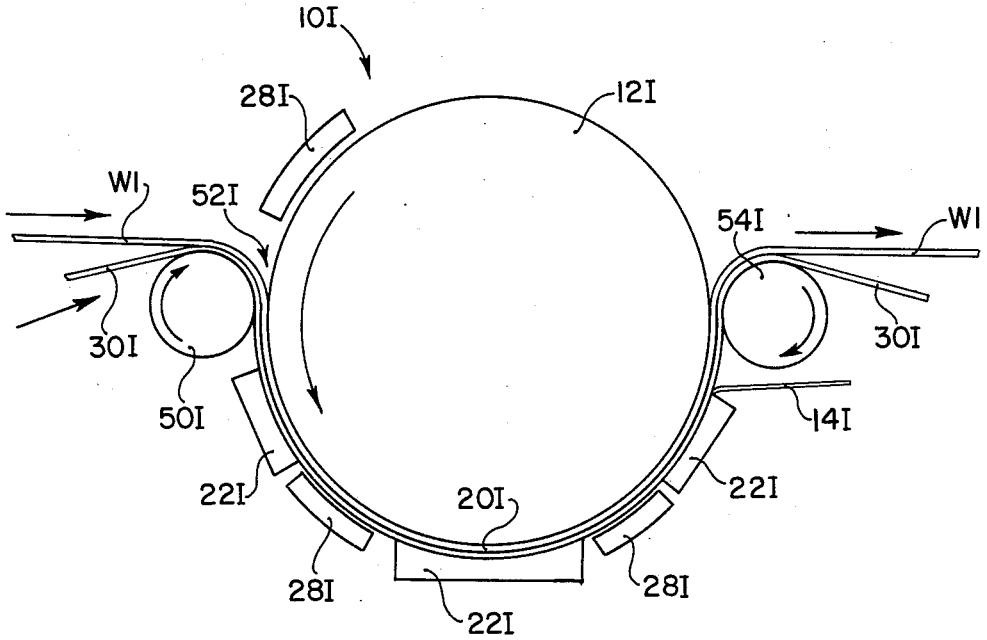
FIG. 10 is a side elevational view of a tenth embodiment of the present invention.

FIG. 10 shows a tenth embodiment of the present invention in which the press apparatus 10I includes a supplementary press roll 50I with the web WI disposed between the felt 30I and the press roll 12I. The felt 30I and the web WI extend through the press nip 52I. A plurality of elongate shoes 22I are disposed along the pressing section 20I. A plurality of heating means 28I are interposed between the elongate means, or shoes, 22I with the blanket means 14I disposed between the elongate means 22I and the felt 30I. A transfer roll 54I is disposed adjacent to the press roll 12I and an additional heating means 281 is disposed adjacent to the press roll 12I upstream relative to the pressing section 20I.

FIG. 11 shows an eleventh embodiment of the present invention in which the elongate means generally designated 22J for urging the blanket means 14J towards the press roll 12J includes a first shoe 56J which defines a concave surface 24J which cooperates with the press roll 12J such that when the blanket means 14J moves relative to the concave surface 24J, the blanket means 14J and the press roll 12J press the web WJ therebetween. As shown in FIG. 11, the press apparatus 10J also includes a second shoe 58J and a first guide means 60J disposed between the first and the second shoes 56J and 58J respectively, with the first guide means 60J being disposed remote relative to the press roll 12J.

The blanket means 14J extends around the first guide means 60J such that the blanket means 14J is removed from the web WJ between the first and the second shoes 56J and 58J respectively.

FIG. 11 also shows a felt 30J which is disposed between the web WJ and the blanket means 14J. A second guide means 62J is disposed between the first and second shoes 56J and 58J respectively with the second guide means 62J being disposed remote relative to the press roll 12J. The felt 30J extends around the second guide means 62J such that the felt 30J is removed from the web WJ thereby inhibiting rewetting of the web WJ.

In each of the foregoing eleven embodiments of the present invention, the heating 28 and 28 (A-J) includes an induction heater. However, the heating means in any of the embodiments may include an infrared heater, microwave heater, directflame heater, resistance heater, laser heater or the like.

Alternatively, as shown in FIG. 12, the heating means generally designated 28K may include a plurality of bores 64K in the press roll 12K for circulating heated oil throughout the press roll 12K.

In each of the embodiments shown in FIGS. 1 to 11, the heater means may be disposed adjacent to the press roll and away from the pressing section such that the press roll or thermal transfer means may be heated prior to coming into contact with the web.

In the embodiments shown in FIGS. 1 to 11, the heating means may also include one or more heaters disposed adjacent to the pressing section so that the web is heated during the application of increased pressure.

In each of the embodiments shown in FIGS. 1 to 12, a preheater 32 may be disposed adjacent to the web to preheat the web to a temperature of up to 212° F. prior to the passage of the web through the pressing section. The preheater 32A shown generally in FIG. 2 includes a steam box 66A and a vacuum slot 68A for drawing steam into the web WA.

Figure 13:
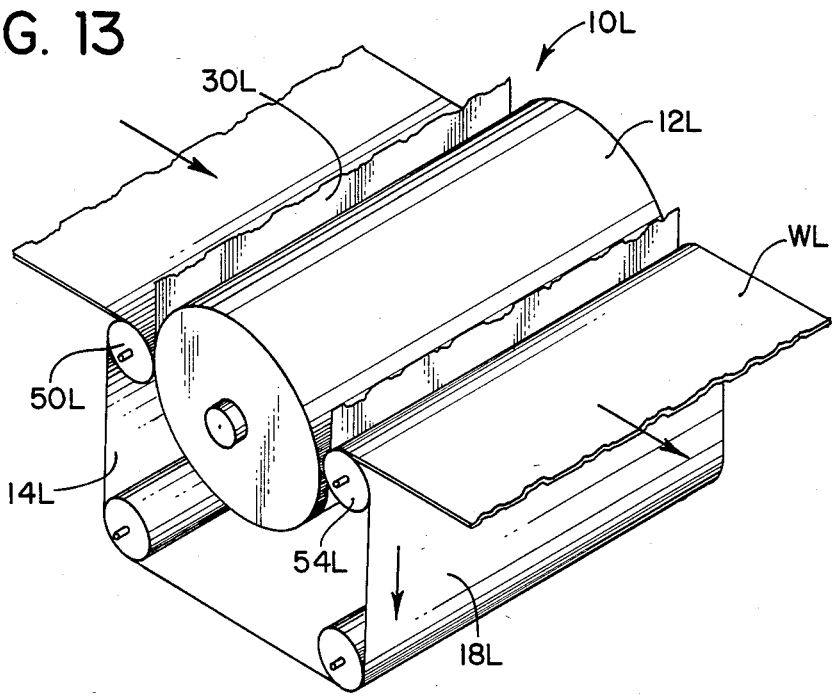
FIG. 13 is a perspective view of the embodiment shown in FIG. 8 showing a plain roll.
Figure 14:
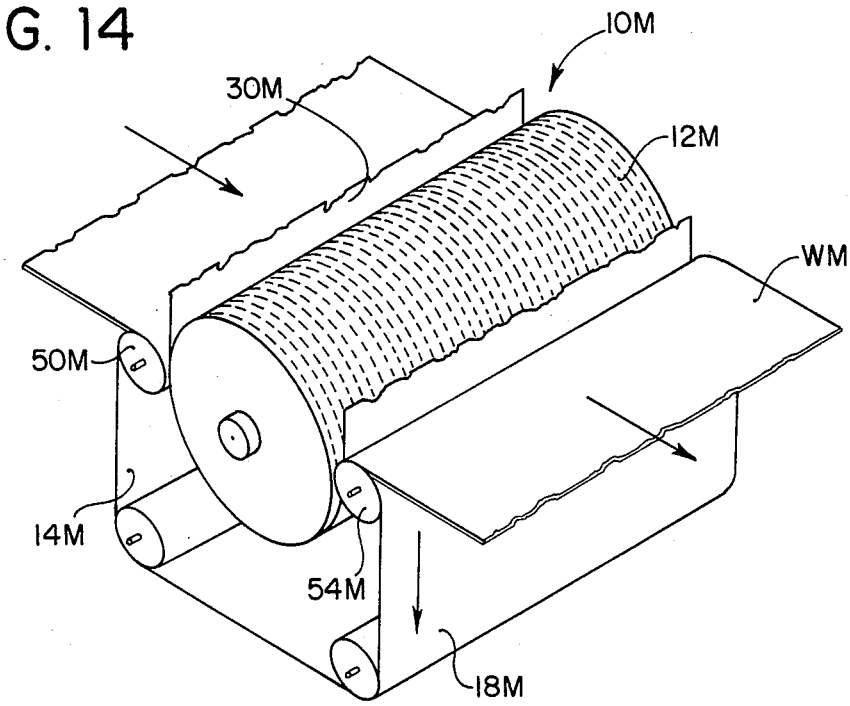
FIG. 14 is a perspective view of the embodiment shown in FIG. 8 showing a vented roll.
Figure 15:
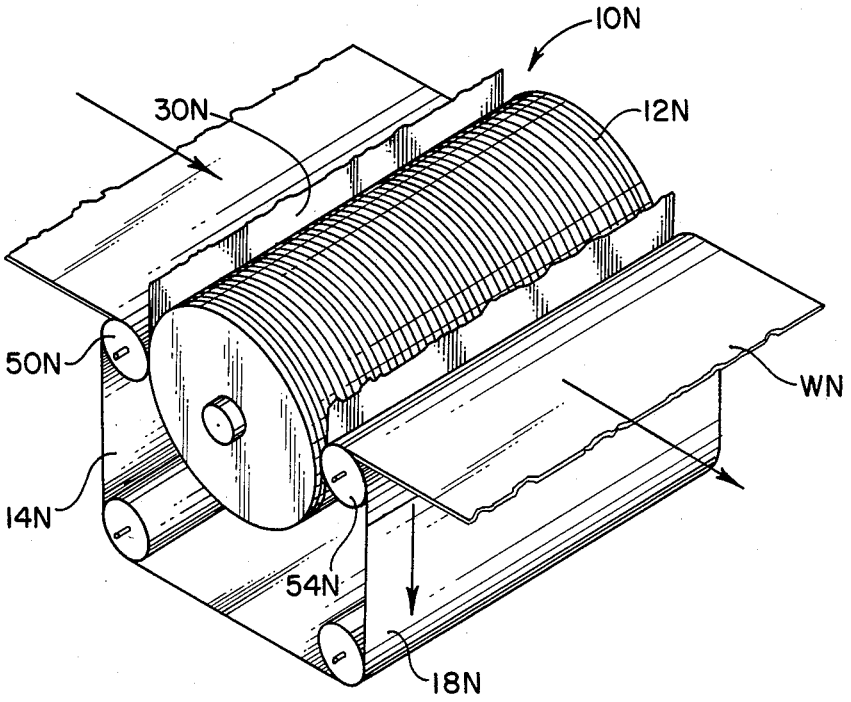
FIG. 15 is a perspective view of the embodiment shown in FIG. 8 showing a grooved roll.

FIGS. 13, 14 and 15 respectively, are perspective views of the embodiments shown in FIG. 8. In FIG. 13 the press roll 12L is a plain roll.

FIG. 14 is similar to FIG. 13, however, the press roll 12M is vented.

FIG. 15 is similar to FIG. 13, however the press roll 12N is grooved.

In any of the embodiments shown in FIGS. 1–15, in which a supplementary or transfer roll is used, such roll or rolls may alternatively be plain, vented or grooved.

As disclosed hereinbefore, by the provision of induction heating directly adjacent to the press roll, an increased transfer of heat to the web is obtained such that water vapor generated within the pressing section by virtue of the increased temperature and pressure over an extended period, drives, or forces water in the liquid phase out of the web. Such induction heating may raise the temperature of the paper within the pressing section to as much as 1200° F. and such high temperature transferred to the web rapidly forces water in the liquid phase out of the web. Because of the use of such high temperature, it has been found that the high pressures currently adopted in extended nip presses may be reduced. Such overall reduction in pressure requirements of the heated ENP make it possible to substitute water in place of oil as lubricant between the blanket and the concave surface of the shoe, or shoes. By the provision of water as the lubricating medium, problems involving contamination of the web are inhibited and the overall construction details of the heated ENP are greatly simplified. Furthermore, by the provision of extremely high temperatures and a corresponding reduction in overall pressure requirements, the present invention envisages a shoe-loading mechanism including a hydraulic mechanism utilizing water as the hydraulic medium in place of oil thereby further inhibiting the possibility of contaminating the web with oil.

Figure 2A:
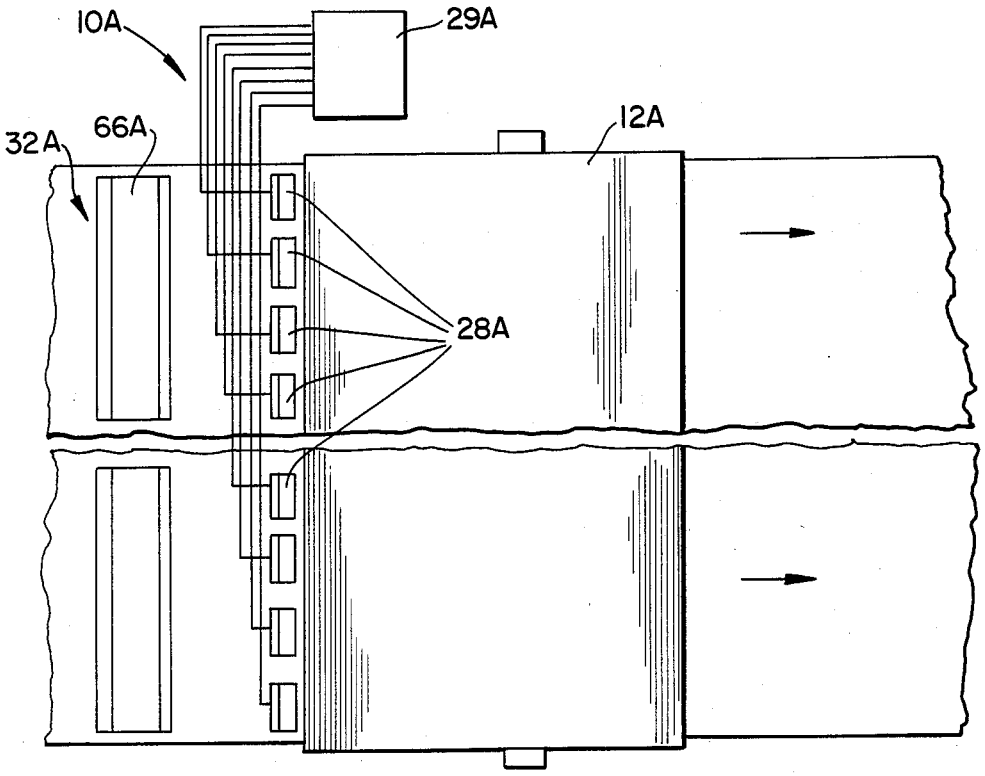
FIG. 2A is a top plan view of an embodiment similar to that shown in FIG. 2 but showing a plurality of induction heaters and a control means therefor.

In addition to the general concept as described hereinbefore, the present invention also envisages other alternative embodiments and advantages associated therewith such as the provision of a plurality of induction heaters as shown in FIG. 2A disposed in a cross-machine direction such that accurate profiling of the resultant web is obtainable as shown in FIG. 2A, the plurality of inductionheaters 28A are controlled by a control means 29A. With such an arrangement, the temperature factor is variable in a cross-machine direction whereas the pressure and period within the pressing section may be kept constant in the cross-machine direction. By such variation in temperature, irregularities in web formation may be compensated for and the resultant web may accordingly be provided having a desired uniformity in the cross-machine direction.

As disclosed hereinbefore, the present concept envisages an embodiment in which, instead of providing a cylindrical press roll and a shoe defining a concave pressing surface, the press roll may be replaced by a second shoe defining a convex surface for cooperating with the concave surface of the first shoe. By the provision of two cooperating blankets with the web sandwiched therebetween, the concept of the present invention may be carried out to provide a resultant web having uniformity of surface characteristics on both sides of the web.

Similarly, in order to provide a resultant web having the desired two-sidedness, or uniformity of surface characteristics, a second heated extended nip press may be provided downstream relative to the first press section to impart the same desired surface characteristics to the opposite side of the web.

In yet another embodiment of the present invention, it may be desirable to pass the web from the forming section through a conventional extended nip press for initial removal of water and then pass the pressed web through a first and second heated extended nip press of the foregoing type to provide two-sidedness of the web together with the required density and moisture content that would require little or no further drying.

By employing the process according to the present invention, the variables of time, pressure and temperature are manipulated to produce the characteristics required in the final product. Intrinsic sheet properties such as strength have, in the prior art processes, been primarily controlled by the fiber mixture used to make the paper. However, to achieve the desired characteristics, a fiber which was pulped by a specific, and expensive process, was often used. This usage of specific, and expensive pulp not only drove up the cost of paper production but also led to underutilization of less expensive types of pulp. Although, in the prior art, the foregoing problem has been addressed through the addition of chemicals in the pulp to enhance the desired properties of the sheet, such solution has led to environmental and corrosion problems relative to the papermaking machine in addition to increasing the cost of making paper.

According to the present invention, the characteristics such as product uniformity and water removal efficiency are addressed through the design and control of the machinery. As described hereinbefore, the web may be preheated through the use of steam or infrared devices such that the preheated temperature of the web approaches 212° Fahrenheit. By the proper application of temperature and pressure over an extended period, the variable properties such as strength, density and smoothness may be attained by the process and apparatus of the present invention. In addition to the foregoing advantages, with regard to reduction of the drying section requirements, the present invention allows the use of cheaper stock, or furnishes, without producing a substandard product. Furthermore, the web produced by the foregoing process according to the present invention, attains higher properties than those currently attainable through the use of additives in the pulp.

In operation of the apparatus according to the present invention, the web may be preheated within a range 180° to 212° Fahrenheit before entering the extended nip press. Such preheating would be carried out by utilizing a steam box and suction element 66,68 as shown in FIG. 2. Alternatively, infrared heating means or a microwave heater could be provided to supply the required energy input to the web. As shown in FIG. 1, the induction heater 28 is used to raise the temperature of the thermal transfer means 18 before entering the pressing section 20. Directly the press member contacts the means 18, heat is transferred to the web further raising the temperature of the web. Because the web continues to contact the thermal transfer means 18 a high web temperature can be maintained throughout the process. In the particular embodiment shown in FIG. 10I, a plurality of induction heaters are disposed between each shoe. According to the present invention, pressures of up to 1,500 psi and roll temperatures of 1,200° Fahrenheit can be obtained.

According to the various embodiments of the present invention, not only can the temperature and pressure be varied, but also by choosing the length and number of shoes, the dwell time of the web within the pressing section can be varied. Thus, once it has been determined what specific conditions are needed to obtain the desired results on a given furnish, the design is flexible enough to accommodate those conditions.

The embodiment of FIG. 11 prevents the web from rewetting due to prolonged contact with the felt and given a sufficiently long felt run, allows the felt to be conditioned between extended nips. A further advantage of this particular configuration is that this arrangement permits the felt along with the ENP shoe to be retracted away from the hot press roll.

Because of the potentially high temperatures and pressures involved in the hot extended nip press according to the present invention, there exist certain design considerations from a safety standpoint which must be taken into account. The pressures exerted by the press apparatus require a press roll with substantial wall thickness. The induction heaters require that the material must be an electrical conductor with metal such as steel or iron being the preferred material. Unfortunately, the thermal mass of an iron or steel roll is considerable—and therefore at a temperature of, for example, 700° Fahrenheit, the press roll would present a considerable hazard in the event of a sheet break or even when the machine is shut down for servicing. Due to these hazards, measures must be taken to minimize the thermal mass of the press roll at such elevated operating temperatures thereby allowing the roll to cool down quickly enough to prevent safety problems.

According to the present invention, the press roll includes a substrate 36B having a low thermal mass and a low thermal conductivity to provide strength covered by an outer layer 38B having a high thermal and electrical conductivity. The outer layer, which is preferably electricallyconductive, is primarily dependent on the thermal requirements of the process. For a larger heat transfer requirement, the outer surface must be thicker. Because the thermal capacity of this particular configuration is much lower than an equivalent all metal roll, running a wet felt on the roll after removing the web, will quickly cool the apparatus to an acceptable level as shown in FIG. 8.

The embodiments of FIGS. 4 and 5 overcome the need of a two-layer press roll by using a metal belt 18C or 18D.

In operation of the embodiment shown in FIG. 8, the healed belt 18G or thermal transfer means never contacts the large, main press roll 12G. Therefore, the press roll 12G will never get above the paper temperature. In the particular embodiment shown in FIG. 8, the rolls 50G and 54G and the remaining two rolls around which the thermal transfer means 18G extend, have a relatively small thermal mass and therefore do not present significant safety concerns.

As described hereinbefore, when the press roll surface is porous, some of the water handling problems are alleviated which might otherwise occur when using a felt only. Furthermore, a vacuum may be applied to the inside of the roll for communication with the surface of the roll for further enhancing water removal and optimizing process efficiency.

In one of the alternative embodiments, instead of the porous surface press roll, a felt may be used in conjunction with a vented roll. The vented press roll provides a place for excess water in the felt to escape. This configuration has been found to be less sensitive due to felt design than is the case with an unvented press roll.

In operation of the embodiment shown in FIG. 9, the extended nip press shoe is removed and pressure is exerted on the web by movement of the rolls 50H and 54H towards each other. By this means, blanket tension is used to control pressure applied to the web. The dwell time is controlled by the amount of wrap around the press roll 12H. The temperature, or heat, input is controlled by the number and power level of the various induction heaters 28H, one of which is shown in FIG. 9. The embodiment shown in FIG. 9 has been found to be advantageous where low pressures and long dwell times are required. Because this particular design configuration allows for flexibility in positioning the heating units 28H, a precise temperature profile can be maintained.

In order to control the various segments of the induction heating units in a cross-machine direction, these induction heaters are connected through a closed-loop control system such that once the desired parameter is sensed, the heat and pressure can be controlled to maintain the desired parameter. By this means, control is obtainable by controlling the temperature to get the desired moisture caliper or whatever other property is desired.

The present invention provides a press apparatus and a method that not only reduces capital expenditure previously required for the provision of dryer drums and ancillary equipment, but also reduces the cost of providing floor space to accommodate such dryer section. Furthermore, the heat input needed for such heated extended nip press apparatus is more than compensated for by the reduction in steam supply fuel requirements previously necessitated by the drying section.

What is claimed is:

1. An apparatus for removing fluid from a fibrous web, said apparatus comprising:

a press member;

blanket means cooperating with said press member for defining therebetween an elongate pressing section such that the web is pressed between said pressing member and said blanket means during passage through said pressing section;

a concave press shoe for urging said blanket means toward said press member such that when the web passes through said pressing section, fluid is removed from the web;

heating means disposed adjacent to said press member for transferring heat to the web and structured such that when the web passes through said pressing section, the web is subjected for an extended period to increased pressure and temperature so that water vapor generated within said pressing section during the passage of the web through said pressing section forces the fluid in the liquid phase away form the web;

a thermal transfer means cooperating with said blanket means for defining said pressing section therebetween, said transfer means transferring heat from said heating means to the web during passage of the web through said pressing section; and a further blanket means disposed between said thermal transfer means and a convex surface defined by said press member such that said blanket means, the web, said thermal transfer means and said further blanket means move together between said convex surface and a cooperating concave surface defined by said concave press shoe for removing fluid from the web.

2. A press apparatus as set forth in claim 1 wherein said heating means is an electrical heater.

3. A press apparatus as set forth in claim 2 wherein said heating means is a first induction heater.

4. A press apparatus as set forth in claim 2 wherein said heating means is an infrared heater.

5. A press apparatus as set forth in claim 2 wherein said heating means is a microwave heater.

6. A press apparatus as set forth in claim 2 wherein said heating means is a laser heater.

7. A press apparatus as set forth in claim 2 wherein said heating means is an electrical resistance heater.

8. A press apparatus as set forth in claim 1 wherein said heating means includes an open-flame burner.

9. A press apparatus as set forth in claim 1 wherein said heating means includes a hot air heater.

10. A press apparatus as set forth in claim 3 further including:

preheating means for heating the web prior to the web extending through said pressing section, said preheating means including:

a steam box;

a vacuum slot for drawing steam into the web.

* * * * *

UNITED STATES PATENT AND TRADEMARK OFFICE

CERTIFICATE OF CORRECTION

PATENT NO. : 4,738,752

DATED : April 19, 1988

INVENTOR(S) : L. H. Busker et al

It is certified that error appears in the above-identified patent and that said Letters Patent are hereby corrected as shown below:

Title page under list of inventors:

Change F. A. Macklem to E. A. Macklem

Signed and Sealed this

Fourth Day of October, 1988

*Attest:*

DONALD J. QUIGG

*Attesting Officer*

*Commissioner of Patents and Trademarks*